US008191251B2

(12) United States Patent
Kurosawa et al.

(10) Patent No.: US 8,191,251 B2
(45) Date of Patent: Jun. 5, 2012

(54) METHOD FOR FORMING RUSTPROOF FILM ON A PC STRAND

(75) Inventors: Ryohei Kurosawa, Tokyo (JP); Kei Hirai, Tokyo (JP)

(73) Assignee: Kurosawa Construction Co., Ltd., Tokyo (JP)

( * ) Notice: Subject to any disclaimer, the term of this patent is extended or adjusted under 35 U.S.C. 154(b) by 0 days.

(21) Appl. No.: 13/125,980

(22) PCT Filed: Apr. 14, 2010

(86) PCT No.: PCT/JP2010/056667
§ 371 (c)(1),
(2), (4) Date: Apr. 26, 2011

(87) PCT Pub. No.: WO2010/122931

PCT Pub. Date: Oct. 28, 2010

(65) Prior Publication Data

US 2011/0209345 A1 Sep. 1, 2011

(30) Foreign Application Priority Data

Apr. 23, 2009 (JP) ..... 2009-105203

(51) Int. Cl.
*H01R 43/00* (2006.01)

(52) U.S. Cl. ..... 29/885; 29/868; 29/869; 29/871; 29/872; 29/852

(58) Field of Classification Search ..... 29/885, 29/603.25, 620, 623.5, 825, 827, 868, 869, 29/871, 872; 428/375, 378, 377, 384; 427/175, 427/180, 172, 177, 195, 197, 202, 203; 57/232, 57/233.1; 52/233.14, 857; 134/26, 10
See application file for complete search history.

(56) References Cited

U.S. PATENT DOCUMENTS 5,263,307 A * 11/1993 Hasui ..... 57/221
(Continued)

FOREIGN PATENT DOCUMENTS

JP 60-110446 6/1985
(Continued)

OTHER PUBLICATIONS

JPO "Notices of Reasons for Refusal" issued Nov. 12, 2010 and Aug. 4, 2010, in a counterpart Japanese application (with English translations).

(Continued)

*Primary Examiner* — David Bryant
*Assistant Examiner* — Tai Nguyen
(74) *Attorney, Agent, or Firm* — Wenderoth, Lind & Ponack, L.L.P.

(57) ABSTRACT

A PC strand is untwisted to separate surrounding wires from a core wire, a synthetic resin powdered coating material is uniformly adhered by being applied and heated over the outer periphery of the core wire and surrounding wires in this untwisted state, the product is cooled to form a resin film, and then the surrounding wires are twisted back to the original state with respect to the core wire. Pre-heating is performed before the coating step and post-heating is performed after the coating step, the pre-heating temperature is set 30 to 130° C. higher than the post-heating temperature, a synthetic resin powdered coating material having an average grain size of 40 to 50 μm is used, and the process line speed is 5 to 10 m/min.

9 Claims, 4 Drawing Sheets

U.S. PATENT DOCUMENTS

| | | | | |
|---|---|---|---|---|
| 6,861,475 | B2 * | 3/2005 | Ilenda et al. | 525/80 |
| 7,241,473 | B2 * | 7/2007 | Hasui et al. | 427/175 |
| 7,323,226 | B2 | 1/2008 | Kittle et al. | |
| 7,585,562 | B2 * | 9/2009 | Hasui et al. | 428/378 |
| 2006/0062929 | A1 | 3/2006 | Kittle et al. | |

FOREIGN PATENT DOCUMENTS

| | | |
|---|---|---|
| JP | 2-033386 | 2/1990 |
| JP | 5-195602 | 8/1993 |
| JP | 7-145618 | 6/1995 |
| JP | 9-096051 | 4/1997 |
| JP | 2691113 | 12/1997 |
| JP | 11-013210 | 1/1999 |
| JP | 11-050597 | 2/1999 |
| JP | 3172486 | 6/2001 |
| JP | 2004-025096 | 1/2004 |
| JP | 3654889 | 6/2005 |
| JP | 2006-509621 | 3/2006 |
| JP | 2006-122808 | 5/2006 |
| JP | 2006-152500 | 6/2006 |
| JP | 2006-212474 | 8/2006 |

OTHER PUBLICATIONS

International Search Report issued Aug. 3, 2010 in International (PCT) Application No. PCT/JP2010/056667.

* cited by examiner

METHOD FOR FORMING RUSTPROOF FILM ON A PC STRAND

TECHNICAL FIELD

The present invention relates to a method for forming rustproof film with a synthetic resin powder coating material on a core wire and surrounding wires of a PC strand used as a tensioning member or stay cable for post-tensioning or pretensioning in prestressed concrete used for structures such as architectural constructions and civil engineering structures, or of a PC strands used as a stay member or stay cable for marine structures and cable-stayed bridges susceptible to salt corrosion. The invention also relates to a PC strand obtained from such method.

BACKGROUND ART

A PC strand generally has a twisted structure of plural surrounding wires twisted around a core wire. The reason for using such a structure is to impart flexibility to the PC strand, and to form helical grooves with the twisted surrounding wires and thus provide a sufficient shear resistance for wires embedded in concrete. Accordingly, there is a need for a rustproof processing method for the PC strand that does not interfere with these characteristics. Currently, a number of rustproof processing methods for the PC strand are known.

One example of such known conventional techniques is "Rustproof film forming and processing method for PC strand" disdosed in Japanese Patent 2691113. In this technique, twisted portions of a PC strand are temporarily untwisted in sequence. The untwisted portions are maintained with a spread maintaining means, and the excess core wire is adjusted. A deposition coating of synthetic resin powder coating material is then formed on whole outer peripheral surfaces of the untwisted core wire and surrounding wires. The deposition coatings are then heat-fused to form films on the whole outer peripheral surfaces of the core wire and surrounding wires. The core wire and the surrounding wires are then twisted again after cooling the films.

The PC strand formed in this manner includes a film formed individually for the core wire and surrounding wires over the whole outer peripheral surfaces. Thus, the method does not interfere with the characteristics required as a PC strand, including flexibility, and the shear resistance of the strand embedded in concrete. Rustproofing is also sufficient. The rustproofing method of this publication is thus praised as the ultimate rustproofing method for a PC strand.

There are de facto standard film thicknesses in industry. Specifically, many research findings report that a thickness of 200 ±50 μm for powder epoxy resin coatings sufficiently satisfy corrosion performance and mechanical performance (impact resistance, flexural property, ease of concrete adhesion). Experiment results from The Federal Highway Administration (FHWA, US) report that the preferred film thickness is about 170 ±50 μm.

Another known conventional technique is "Method for forming a double film for PC strand" disclosed in Japanese Patent 3172486. In this technique, surrounding wires of a PC strand are temporarily untwisted from a core wire in sequence, and a rustproof film is formed on the whole outer peripheral surfaces of the core wire and the surrounding wires in the untwisted state. Then, the surrounding wires are twisted back while accumulating and absorbing the excess core wire resulting from the increased diameter. A protective film is then formed over the rustproof film. When a stably maintained maximum thickness of 250 μm or more is required for rustproof film subject to potential damage in some special structure, a double film is formed by forming a thick protective film on the outer peripheral surface of the PC strand formed by using the foregoing first conventional technique.

Another known conventional technique is "Method for forming rustproof film on PC strand" disclosed in Japanese Patent 3654889. In this technique, a PC strand formed after plating of its elemental wires is untwisted, and a resin film is formed on the whole outer peripheral surfaces of the core wire and the surrounding wires, which are then twisted again after cooling the resin film.

Citation List

Patent Literature

PTL1: Patent 2691113

PTL2: Patent 3172486

PTL3: Patent 3654889

Though the first conventional technique of forming a rustproof resin film 200 ±50 μm thick is praised as the ultimate rustproofing method, the process line speed used to form the resin film in this thickness range is only about 4.5 m/min or less. Increasing the process line speed above this range fails to provide an intended thickness. Attempts to provide an intended thickness result in poor productivity.

In the second conventional technique, a bilayer structure is formed by forming a granular material-containing protective film on the rustproof film formed on the PC strand, in order to prevent damage to the rustproof film used for some special structure and subject to external force during construction. However, the increased film thickness impairs not only the flexibility required of the PC strand, but productivity.

The third conventional technique involves a rustproofing process that forms a double film by plating and resin film. While the method excels in rustproofing, the technique requires plating at an early stage of PC strand production. This is problematic because the plated members need to be separately stored and controlled from non-plated members. Further, the method requires the additional plating step, and has a restricted process line speed for forming the resin film, as in the first conventional technique. All this leads to poor production efficiency, and increased costs of manufacture and control.

None of the conventional techniques investigates the relationship between coating line speed and coating resin powder for efficient formation of a more desirable film with improved productivity.

SUMMARY OF INVENTION

Technical Problem

Accordingly, the invention is intended to efficiently form a uniform and desirable film that has improved tensile fatigue characteristics, and can be formed at high line speed to improve productivity and lower costs, without losing the flexibility required of the PC strand, and the adhesion strength for concrete.

Solution to Problem

According to the present invention, there is provided a method for forming a rustproof film on a PC strand, the method including: an untwisting step of untwisting the PC strand to separate surrounding wires from a core wire in the PC strand running through a series of process lines; a coating step of applying a synthetic resin powder coating material on each outer peripheral surface of the core wire and the surrounding wires in the untwisted state; a heating step of heating the core wire and the surrounding wires in the untwisted state; a cooling step of cooling the core wire and the surrounding wires with the synthetic resin powder coating material uniformly adhered thereon after the coating step and the heating step, so as to form a resin film; and a twisting step of twisting the surrounding wires to restore the original state with the core wire. The heating step includes pre-heating and post-heating performed before and after the coating step of applying the synthetic resin powder coating material, and the heating temperature in the pre-heating is set 30 to 130° C. higher than the heating temperature in the post-heating. The synthetic resin powder coating material has an average grain size of 40 to 50 μm and the series of process lines has a line speed of 5 to 10 m/min to provide a thickness set for the resin film.

In the method for forming a rustproof film on a PC strand according to the present invention, it is preferable that the thickness set for the resin film be 100 to 280 μm.

A PC strand according to the present invention includes a rustproof film formed by using the method for forming a rustproof film on a PC strand.

Advantageous Effects of Invention

In the method for forming a rustproof film on a PC strand according to the present invention, the heat treatment of the PC strand includes pre-heating and post-heating that are performed before and after the coating step of applying a synthetic resin powder coating material, and a higher heating temperature is set for the pre-heating than for the post-heating. Further, the applied synthetic resin powder coating material has an average grain size of 40 to 50 μm, and a relatively high line speed of 5 to 10 m/min is used. These are highly effective at efficiently forming a uniform and desirable coating at low cost while improving the productivity of the PC strand, without losing the flexibility of the PC strand, and the shear resistance of the wire embedded in concrete.

DESCRIPTION OF EMBODIMENTS

Figure 1:
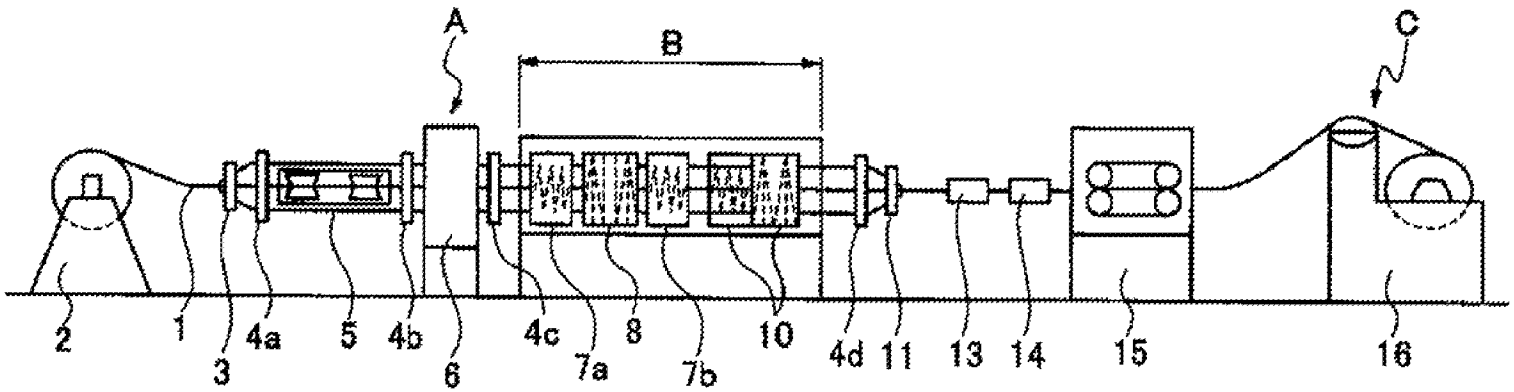
FIG. 1 is a side view schematically illustrating a process line used by a processing method according to an embodiment of the present invention.
Figure 2:
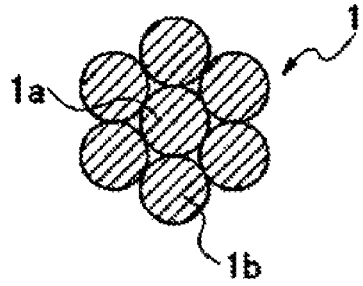
FIG. 2 is a cross sectional view illustrating a PC strand processed in the embodiment.

The present invention is described below in detail based on an embodiment with reference to the accompanying drawings. FIG. 1 is a schematic diagram representing a process line for the method for forming a rustproof film on a PC strand according to the present invention. As illustrated in FIG. 2, a PC strand 1 used in this embodiment is a PC strand formed from a total of seven elemental wires that include a central core wire 1*a* and a plurality of (six) surrounding wires 1*b* twisted around the core wire 1*a* in a helix.

As a rule, this type of PC strand as represented by the PC strand 1 is a coil of long wire. The PC strand 1 in a coil is set at the starting end of the process line as in the conventional example, and unreeled from one end for the rustproof film forming process.

As illustrated in FIG. 1, a coil of PC strand 1 is set on a mount 2 provided at the starting end of the process line according to the present invention, and the PC strand 1 set on the mount 2 is pulled out, and subjected to a series of steps in the rustproof film forming process. Specifically, the steps include pretreatment step A and coating step B through which the original stranded state is restored, and reeling step C in which the coated PC strand is reeled into a coil at the terminating end of the process line. The following describes each step.

First, as a preparation for the continuous operation of the process line, a dummy PC strand for the PC strand 1 to be rustproofed is manually set through the starting end to the terminating end of the process line, according to the category or technique used in each step. The ends of the core wire 1*a* and the surrounding wires 1*b* in the PC strand 1 set on the mount 2 for rustproofing are then mated and welded to the corresponding ends of the core wire and surrounding wires of the dummy PC strand. The continuous operation is started after the completion of this preparation.

Running the process line apparatus moves the PC strand 1 from the starting end to the terminating end of the process line at a constant speed. During the course of travel, a uniform film (coating film) is formed on the outer peripheral surfaces of the core wire 1*a* and the surrounding wires 1*b* respectively, which are then reeled after being twisted back into the original state.

Figure 3:
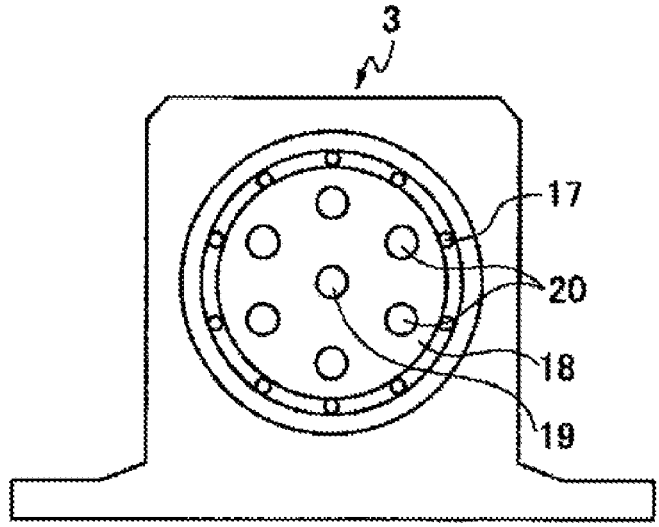
FIG. 3 is a schematic front view illustrating an untwister (twister) used in the embodiment.
Figure 4:
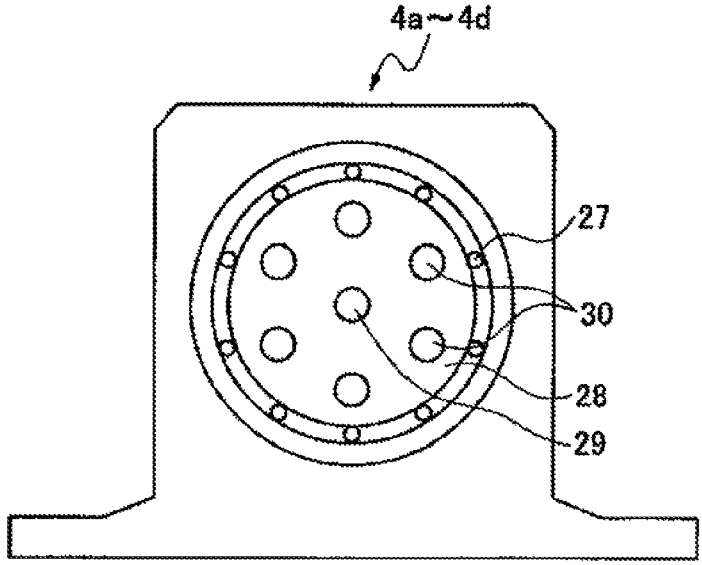
FIG. 4 is a schematic front view illustrating a spreader used in the embodiment.

The PC strand 1 set on the mount 2 first passes through the pretreatment step A via a core wire adjuster 5. Here, an untwister 3 illustrated in FIG. 3 untwists the surrounding wires 1*b* from the core wire 1*a*, spreading the PC strand 1. Spread maintaining unit 4*a* to 4*d* shown in FIG. 4 maintain the spread state, and the PC strand 1 in the maintained spread state is carried at a preset speed to the coating step B where a coating is formed.

The untwister 3 includes bearings 17, a rotating ring 18 rotatably provided via the bearings 17, a core wire hole 19 formed at the central portion of the rotating ring 18 and through which the core wire 1*a* of the PC strand 1 is inserted, and six surrounding wire holes 20 radially provided with the required distance from the core wire hole 19 and through which the corresponding surrounding wires 1*b* are inserted.

The spread maintaining units 4*a* to 4*d* are configured in substantially the same manner as the untwister 3 but with a slightly larger diameter. The spread maintaining units 4*a* to 4*d* maintain the spread state of the untwisted PC strand 1, and include a rotating ring 28 rotatably provided via bearings 27. The rotating ring 28 includes a core wire hole 29 formed at the central portion and through which the core wire 1*a* of the PC strand 1 is inserted, and six surrounding wire holes 30 radially provided with the required distance from the core wire hole 29 and through which the corresponding surrounding wires 1*b* are inserted. The spread maintaining units 4*a* to 4*d* differ from the untwister 3 in that the distance between the core wire hole 29 and the surrounding wire holes 30 is greater. The size of each hole is substantially the same.

A shotblaster 6 used in the pretreatment step A improves the ease of deposition or adhesion for the coating, as follows. A polisher (about 0.3 mm-steel balls) is thrown at the whole outer peripheral surfaces of the core wire 1*a* and the surrounding wires 1*b* in the spread state using high-speed rotating blades to remove foreign objects such as oil and rust adhered on the outer peripheral surfaces, and to condition the base of the whole outer peripheral surface into, for example, a pear-skin surface.

Figure 5:
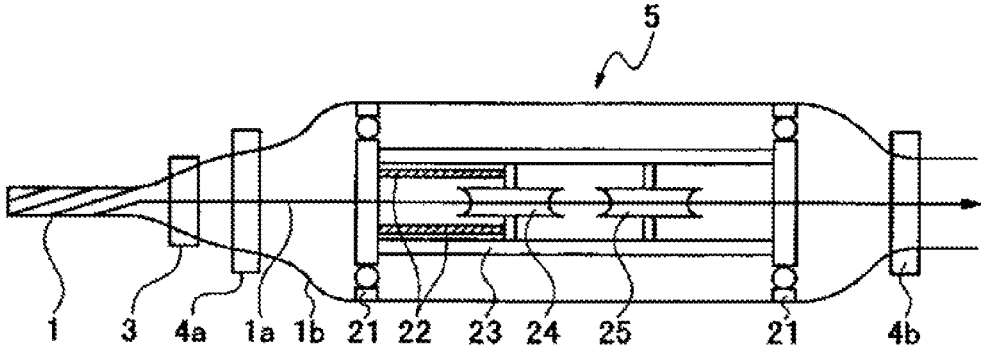
FIG. 5 is a side view schematically illustrating an example of a core wire adjuster used in the embodiment.
Figure 6:
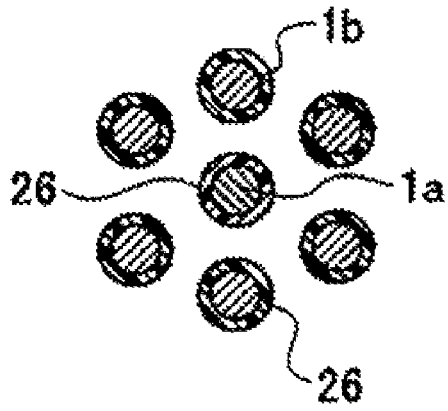
FIG. 6 is a cross sectional view of a PC strand in a spread state after a coating step of the embodiment.

The core wire adjuster 5 shown in FIG. 5 is disposed between the spread maintaining units 4*a* and 4*b*, between the mount 2 and the shotblaster 6 used in the pretreatment step A. The core wire adjuster 5 is constructed from a pair of outer rings 21, a pulley arm 23 that maintains a predetermined distance between the outer rings 21, a movable pulley 24 movable along the pulley arm and pulled toward the untwister 3 with a certain tension with a tension adjusting spring 22, and a fixed pulley 25 attached to the pulley arm 23. With this construction, the surrounding wires 1*b* can be guided on the outer side of the outer rings 21, which remain freely rotatable corresponding to the twist pitch of the surrounding wires 1*b* in the PC strand 1. The core wire 1*a* through the core wire hole 29 of the spread maintaining unit 4*a* is first looped through the fixed pulley 25, and, after a U-turn, through the movable pulley 24 in the core wire adjuster 5, before being carried toward the spread maintaining units 4*b*. The core wire adjuster 5 constructed as above adjusts the core wire 1*a* by pulling back the excess that results from the twisting of the surrounding wires 1*b* thickened by forming the rustproof film back to the original state.

Note that the movable distance and the number of grooves in the movable pulley 24 are decided according to the excess length of the core wire to be absorbed or drawn back. For example, the capacity to accumulate and absorb the excess core wire becomes 4 times higher with two pulley grooves. Because the movable pulley 24 is pulled toward the untwister 3 under the constant tension of the tension adjusting spring 22, any excess in the core wire 1*a* resulting from the twisting of the surrounding wires 1*b* back to the original state with the core wire 1*a* at the terminating end can be automatically absorbed or drawn back. The core wire adjuster is not restricted to the foregoing pulley system.

The core wire 1*a* and the surrounding wires 1*b* treated in the pretreatment step A are maintained in the spread state by the spread maintaining units 4*c* and 4*d*, and fed to the coating step B while undergoing rotation substantially corresponding to the twist pitch of the surrounding wires. In the coating step B, a pre-heater 7*a* applies heat, and a powder coater 8 forms a resin film 26 on the respective whole outer peripheral surfaces, independently for the core wire 1*a* and the surrounding wires 1*b*. The resin film 26 is in the molten state under the pre-heating temperature. The heating temperature of the post-heater 7*b* smoothes the resin film 26 as a whole in substantially a uniform fashion. A cooler 10 sufficiently cools the resin film 26 to improve the surface hardness of the resin film 26.

Desirably, the pre-heater 7*a* and the post-heater 7*b* are high-frequency induction heaters that enable easy temperature adjustment. Further, the method used to supply the powder coating material is desirably an electrostatic powder coating method, and may be a gun spraying method or a fluidized dipping method. The state of the resin film 26, specifically, the thickness and quality of the resin film 26 are determined according to such factors as the heating method and temperature, the type, number, and position of the electrostatic guns, the state of air, and the grain size and the mixture ratio of the powder coating material.

The cooler 10 may cool the resin film 26 by showering cold water over a certain range. Preferably, the resin film 26 is cooled in two steps. Specifically, the first cooling and the second cooling are performed back to back, whereby the film surface in the first cooling is gradually cooled with, for example, air-coding means that blows cool air to the resin film 26, followed by rapid cooling with a shower of cold water. In this way, the surface of the resin film 26 can be smoothed substantially uniformly.

Figure 7:
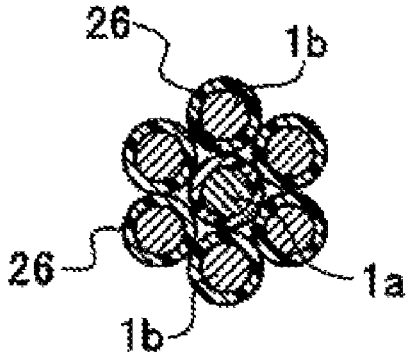
FIG. 7 is a cross sectional view of a PC strand with the surrounding wires twisted back to the original state with the core wire after the coating step of the embodiment.

The thickness of the resin film 26 formed in the coating step B is, for example, about 100 to 280 μm. After the resin film 26 is formed in the coating step B, a twister 11 twists the surrounding wires 1*b* back to the original state with the core wire 1*a*. The twister 11 is the same unit used for the untwister 3 shown in FIG. 3, except that the lead-in and lead-out side of the PC strand 1 are on the opposite sides, as illustrated in FIG. 1. Because the configuration is essentially the same, the configuration of the twister 11 will not be described further, and should be understood essentially by referring to FIG. 3. Because the surrounding wires 1*b* remain twisting habit even after the formation of the resin film 26, the twister 11 can quickly twist the surrounding wires 1*b* back to the original state with the core wire 1*a*. The cross sectional shape of the PC strand 1 twisted back to the original state is as shown in FIG. 7. The resin film 26 of uniform thickness is formed over the whole peripheral surfaces of the core wire 1*a* and the surrounding wires 1*b*.

The PC strand 1 twisted back to the original state after the formation of the resin film 26 is tested for the resin film 26. First, a thickness measurement device 13 measures the thickness of the resin film 26. When the thickness does not fall in the preset acceptable range, an alarm is set off, and a signal indicative of an insufficient or excessive thickness is sent out. Further, a pinhole detector 14 inspects the state of the resin film 26. The test uses a non-contact type detector, for example, such as optical detecting means, to prevent damage to the resin film 26, and, if a pinhole is detected in the resin film 26, the detected position is marked, and an alert signal is sent out.

The PC strand 1 so tested is drawn with a drawer 15, and subjected to reeling step C with a reeler 16 disposed at the terminating end of the process line. In the final reeling step C, the coated PC strand 1 is reeled into a coil. The drawer 15 is structured to include upper and lower endless rubber bells, which hold and carry the PC strand in between. The resin film 26 is thus not damaged by the drawer 15. The drawer 15 also serves to set a process line speed with the structure that enables the line speed to be freely changed with the use of an inverter motor. Provided that conditions such as the pre-heating temperature conditions, and the ejection amounts of the resin coating material are constant, varying the line speed varies the thickness of the film formed on the elemental wires. Thus, a film of any thickness can be formed by selecting a line speed.

The continuous operation of the process line is stopped when the PC strand 1 set on the mount 2 has run out. The film formation in the process line is then suspended, and a new PC strand is set on the mount 2. The operation resumes after the rear end of the processed PC strand 1 is welded to the leading end of the newly set PC strand 1.

The PC strand 1 formed with the resin film 26 has the resin film 26 independently or separately formed on each surface of the core wire 1*a* and the surrounding wires 1*b* respectively. Thus, the required flexibility for this type of PC strand remains intact, and the corrosion resistance and tensile fatigue resistance can be improved.

A PC strand with a desirable resin film can be obtained with improved production efficiency according to the method for forming rustproof film on PC strand of the invention under certain conditions concerning the process line speed, the coating material grain size, and the heating temperature, as follows.

The appropriate line speed is 5 to 10 m/min. A line speed below 5 m/min is disadvantageous from the economical standpoint, because it cannot be expected to improve productivity and raises cost. With a line speed above 10 m/min, the core wire 1*a* and the surrounding wires 1*b* are twisted back to the original state before the applied coating material sufficiently cures. This may cause the resin film (coating film), independently formed for the core wire 1*a* and each surrounding wire 1*b*, to adhere mutually, or may cause partial deformation in each resin film by the pressure of the twisting to restore the original state. These are problematic because the wires lose not only uniformity but also the required flexibility. The most preferable line speed is 7 to 8 m/min; however, the lower limit and upper limit can extend to 5 m/min and 10 m/min, respectively The time for curing the coating material adhered on the core wire 1*a* and the surrounding wires 1*b* in the process line can be increased by setting a longer distance for the heating of the coated core wire 1*a* and surrounding wires 1*b* in the spread state. However, because the coating process is performed in the spread state with each surrounding wire 1*b* maintaining its twisting habit for the core wire 1*a*, the distance for maintaining the spread state, specifically, the focus distance for twisting the wires back to the original state is set within a certain range. Increasing the distance above this range may fail to maintain such twisting habit in the surrounding wires 1*b*. Further, increasing the spread distance of the coated core wire 1*a* and surrounding wires 1*b* may cause a slack in the elemental wires (cone wire or surrounding wires). Such slacks cause production problems, for example, by causing the wires to contact the equipment as the wires rotate during their movement in the process line, or by causing the elemental wires to contact with each other. Thus, in practice, the distance for maintaining the spread state cannot be increased above the set range.

The coating material is a heat-curable epoxy resin. As to the powder grain size, materials having an average grain size of 40 to 50 μm are used. Most preferably, the coating material includes substantially uniformly distributed grains with an average grain size of 45 μm, a minimum grain size of 10 μm, and a maximum grain size of 100 μm. Smaller grain sizes produce a film that is thin and excels in uniformity, whereas larger grain sizes produce a thick film. It should be noted, however, that the excess coating material in the coating step is sorted into a dust collection and disposal step and a recyde step. When the coating material contains only grains with a grain size of 10 μm or less, many grains are sucked into the dust collector, and disposed without being reused, wasting the material. On the other hand, when all the grains in the coating material exceed 100 μm in grain size, only a few grains are sucked into the dust collector, and as such the loss is small. However, in this case, foaming occurs between the elemental wires and the film, and pinholes are likely to occur in the film. Further, the film becomes nonuniform and shows a rough surface texture after the coating process, making it difficult to perform desirable quality control for the product. Accordingly, coating materials containing substantially uniformly distributed grains with an average grain size of 45±5 μm over a grain size range of 10 to 100 μm are preferable.

The heating temperature of the elemental wires by the pre-heater 7*a* ranges from 150 to 250° C. The heating temperature by the post-heater 7*b* ranges from 120 to 220° C. The pre-heating temperature is made higher than the post-heating temperature by 30 to 130° C. Specifically, the electrostatic powder coating is performed with the pre-heating performed at a temperature 30 to 130° C. higher than the post-heating temperature in the foregoing temperature range. In this way, the coating material deposited on the elemental wires quickly melts into a uniform thickness, and the subsequent post-heating further promotes a curing reaction without causing heat denaturation in the resin.

Example

In this Example, rustproof films were formed on PC strands in the foregoing ranges of conditions. The coatings were performed by using the same coating materials and setting the pre-heating temperature and the post-heating temperature to 200° C. and 140° C., respectively, but varying process line speeds to obtain PC strands with rustproof films having thickness of 60 μm, 70 μm, 80 m, 90 μm, 100 μm, 110 μm, 120 μm, 130 μm, 150 μm, 180 μm, and 220 μm, respectively. By the way, the 150-μm thick film was obtained at the line speed of 7 m/min. The line speed was increased in 1 m/min increments, and the 110-μm thick film was obtained at the line speed of 10 m/min. Conversely, the line speed was decreased in 0.5 m/min decrements, and the 220-μm thick film was obtained at the line speed of 6 m/min. Note that, given the same line speed, increasing the ejected amount of the resin coating material by raising the pre-heating temperature inevitably produces a thicker film.

The PC strands obtained as above were subjected to a salt spray test, which was performed for 1,000 hours with a salt spray tester according to the JIS 22371 "salt spray testing method" (spray tower method). The test results are as shown in Table 1.

TABLE 1

| | Rusting time | | | | | |
|---|---|---|---|---|---|---|
| Coating thickness | 48 hours | 120 hours | 216 hours | 360 hours | 500 hours | 1,000 hours |
| 60 μm | * | X | X | X | X | X |
| 70 μm | ○ | * | X | X | X | X |
| 80 μm | ○ | ○ | * | X | X | X |
| 90 μm | ○ | ○ | ○ | * | X | X |
| 100 μm | ○ | ○ | ○ | ○ | ○ | ○ |
| 110 μm | ○ | ○ | ○ | ○ | ○ | ○ |
| 120 μm | ○ | ○ | ○ | ○ | ○ | ○ |
| 130 μm | ○ | ○ | ○ | ○ | ○ | ○ |
| 150 μm | ○ | ○ | ○ | ○ | ○ | ○ |
| 180 μm | ○ | ○ | ○ | ○ | ○ | ○ |
| 220 μm | ○ | ○ | ○ | ○ | ○ | ○ |

*: Rusting started
X: Rusting
○: Normal

As presented in Table 1, no rusting occurs until at least 1,000 hours with the thickness of 100 μm or more, demonstrating that desirable coatings were formed. It should be noted that the conditions used in this Example, including pre-heating and post-heating temperatures, are averages. Increasing the pre-healing temperature to, for example, 230° C. increases the thickness with the increased adhesion amount of the coating material. Further, because the coating material contains grains of varying sizes, the smaller grains enter the spaces between the larger grains, thereby dosing the voids between the coating grains and eliminates air bubbles. As a result, a uniform coating is formed.

Industrial Applicability

The method for forming a rustproof film on a PC strand according to the present invention, with the reasonable combinations of the synthetic resin powder coating grain size, the temperature settings for pre-heating and post-heating, and the line speed, enables efficient production of a uniform and desirable film with improved productivity, without impairing flexibility and the shear resistance of the strand embedded in concrete. The method therefore has a wide range of applications in the rustproof processing technique for PC strands used as tensioning members or stay cables for the post-tensioning or pre-tensioning in prestressed concrete used for structures such as architectural constructions and civil engineering structures. The method also has wide applications in the rustproof processing technique for PC strands used as stay members or stay cables for marine structures and cable-stayed bridges susceptible to salt corrosion.

| Reference Signs List | |
|---|---|
| 1 | PC strand |
| 1a | Core wire of PC strand |
| 1b | Surrounding wires of PC strand |
| 2 | Mount |
| 3 | Untwister |
| 4a, 4b, 4c, 4d | Spread maintaining unit |
| 5 | Core wire adjuster |
| 6 | Shot blaster |
| 7a | Pre-heater |
| 7b | Post-heater |
| 8 | Powder coater |
| 10 | Cooler |
| 11 | Twister |
| 13 | Thickness measurement device |
| 14 | Pinhole detector |
| 15 | Drawer |
| 16 | Reeler |
| 17, 27 | Bearings |
| 18, 28 | Rotating ring |
| 19, 29 | Core wire hole |
| 20, 30 | Side wire holes |
| 21 | Outer ring |
| 22 | Tension adjusting spring |
| 23 | Pulley arm |
| 24 | Movable pulley |
| 25 | Fixed pulley |
| 26 | Resin film |
| A | Pretreatment step |
| B | Coating step |
| C | Reeling step |

The invention claimed is:

1. A method of forming a rustproof film on a PC strand, the method comprising:

conveying the PC strand at a line speed of 5 to 10 m/min through a process line;

untwisting the PC strand to separate surrounding wires from a core wire in the PC strand;

applying a synthetic resin powder coating material on each outer peripheral surface of the core wire and the surrounding wires in the untwisted state;

heating to adhere the coating uniformly on each of the peripheral surfaces;

cooling to form a resin film, after said cooling operation, twisting the surrounding wires around the core wire, wherein the heating operation includes pre-heating performed before said applying the synthetic resin powder coating material operation and post-heating performed after said applying the synthetic resin powder coating material operation, wherein the heating temperature in the post-heating is set in a range of 120-220° C., wherein the heating temperature in the pre-heating is set 30 to 130° C. higher than the heating temperature in the post-heating operation, wherein the synthetic resin powder coating material has an average grain size of 40 to 50 μm to provide a set thickness for the resin film, and wherein the thickness of the resin film is 200±80 μm.

2. The method of claim 1, the heating temperature in the pre-heating is set in a range of 150-250° C.

3. The method of claim 2, wherein the line speed is 7 to 8 m/min.

4. The method of claim 2, wherein the process line includes, in order from upstream to downstream:

an untwister at which said untwisting operation is performed;

a pre-heater at which said pre-heating operation is performed;

a powder coater at which said applying the synthetic resin powder coating material operation is performed;

a post-heater at which said post-heating operation is performed;

a cooler at which said cooling operation is performed; and a twister at which said twisting operation is performed.

5. The method of claim 4, the heating temperature in the pre-heating is set in a range of 150-250° C.

6. The method of claim 5, wherein the line speed is 7 to 8 m/min.

7. The method of claim 1, wherein the line speed is 7 to 8 m/min.

8. The method of claim 1, wherein the process line includes, in order from upstream to downstream:

an untwister at which said untwisting operation is performed;

a pre-heater at which said pre-heating operation is performed;

a powder coater at which said applying the synthetic resin powder coating material operation is performed;

a post-heater at which said post-heating operation is performed;

a cooler at which said cooling operation is performed; and a twister at which said twisting operation is performed.

9. The method of claim 8, wherein the line speed is 7 to 8 m/min.

* * * * *